US006724137B2

(12) United States Patent
Shin et al.

(10) Patent No.: US 6,724,137 B2
(45) Date of Patent: Apr. 20, 2004

(54) TENSION MASK FRAME ASSEMBLY FOR COLOR CATHODE RAY TUBE

(75) Inventors: Soon-Cheol Shin, Suwon (KR); Chan-Yong Kim, Incheon Metropolitan (KR); Sang-Shin Choi, Suwon (KR); Sang-Ho Jeon, Seongnam (KR)

(73) Assignee: Samsung SDI Co., Ltd., Suwon (KR)

( * ) Notice: Subject to any disclaimer, the term of this patent is extended or adjusted under 35 U.S.C. 154(b) by 387 days.

(21) Appl. No.: 09/837,549

(22) Filed: Apr. 19, 2001

(65) Prior Publication Data

US 2002/0014822 A1 Feb. 7, 2002

Related U.S. Application Data

(63) Continuation-in-part of application No. 09/712,952, filed on Nov. 16, 2000, now Pat. No. 6,630,775.

(30) Foreign Application Priority Data

Nov. 16, 1999 (KR) ..... 1999-50943

(51) Int. Cl.[7] ..... H01J 29/80

(52) U.S. Cl. ..... 313/403; 313/402; 313/407; 313/408

(58) Field of Search ..... 31/402, 403, 407, 31/408

(56) References Cited

U.S. PATENT DOCUMENTS

| | | | | |
|---|---|---|---|---|
| 4,926,089 A | | 5/1990 | Moore | 313/403 |
| 4,942,332 A | | 7/1990 | Adler et al. | 313/402 |
| 4,942,333 A | | 7/1990 | Knox | 313/402 |
| 4,973,283 A | | 11/1990 | Adler et al. | 445/30 |
| 5,072,150 A | | 12/1991 | Lee | 313/405 |
| 5,126,624 A | | 6/1992 | Ji | 313/402 |
| 5,210,459 A | | 5/1993 | Lee | 313/406 |
| 5,280,215 A | * | 1/1994 | Ohtake et al. | 313/403 |
| 5,488,263 A | | 1/1996 | Takemura et al. | 313/402 |
| 5,523,647 A | | 6/1996 | Kawamura et al. | 313/407 |
| 5,534,746 A | | 7/1996 | Marks et al. | 313/408 |
| 6,057,640 A | | 5/2000 | Aibara | 313/403 |
| 6,072,270 A | | 6/2000 | Hu et al. | 313/402 |
| 6,097,142 A | | 8/2000 | Ko | 313/402 |
| 6,455,991 B2 | * | 9/2002 | Tsuji | 313/402 |

* cited by examiner

*Primary Examiner*—Edward J. Glick
*Assistant Examiner*—Jurie Yun
(74) *Attorney, Agent, or Firm*—Robert E. Bushnell, Esq.

(57) ABSTRACT

A tension mask frame assembly for a color cathode ray tube, includes: a tension mask having a plurality of strips on which slots are formed, the slots being separated by a predetermined distance from each other on a thin plate; real bridges for partitioning slots at a predetermined pitch interval by connecting adjacent ones of a plurality of strips to each other; and a frame which supports the corresponding edges of the tension mask; whereby the vertical pitch of the real bridges becomes smaller, such as in a stepwise relation, in a direction from the center portion of the tension mask to the peripheral portion of the tension mask.

48 Claims, 9 Drawing Sheets

TENSION MASK FRAME ASSEMBLY FOR COLOR CATHODE RAY TUBE

CLAIM OF PRIORITY

This application makes reference to, incorporates the same herein, and claims all benefits accruing under 35 U.S.C. §119 from an application entitled TENSION MASK FRAME ASSEMBLY FOR COLOR CRT earlier filed in the Korean Industrial Property Office on the 16$^{th}$ day of November 1999, and there duly assigned Ser. No. 99-50943.

CROSS-REFERENCE TO RELATED APPLICATION

This application is a continuation-in-part of U.S. application Ser. No. 09/712,952 filed in the U.S. Patent & Trademark Office on Nov. 16, 2000 now U.S. Pat. No. 6,630,775, U.S. application Ser. No. 09/712,952 being incorporated herein by reference. Also, this application makes reference to, incorporates the same herein, and claims priority and all benefits accruing under 35 U.S.C. §120 from the aforementioned U.S. application Ser. No. 09/712,952, filed on Nov. 16, 2000, entitled TENSION MASK FRAME ASSEMBLY FOR COLOR CATHODE RAY TUBE.

BACKGROUND OF THE INVENTION

1. Field of the Invention

The present invention relates to color cathode ray tubes, and more particularly, to a tension mask frame assembly for a color cathode ray tube, having an improved tension mask which is fixed to a frame.

2. Description of the Related Art

In color cathode ray tubes (color CRTs), an electron beam emitted from an electron gun lands on a fluorescent film through electron beam passing holes in a shadow mask and excites the fluorescent film to form an image.

The screen surface of conventional color CRTs which form an image as described above is designed so as to have a predetermined curvature in consideration of the deflection trajectory of an electron beam which is emitted from an electron gun and deflected by a deflection yoke. The tension mask is designed so as to have a curvature corresponding to the curvature of the screen surface.

A shadow mask, which is manufactured so as to have a curvature similar to the curvature of the inner surface of the screen surface, is heated by an electron beam, that is, by a thermoelectron, emitted from the electron gun, which causes a doming phenomenon in which the shadow mask is swollen toward a panel. The doming phenomenon prevents the electron beam from accurately landing on the fluorescent film. As described above, the screen surface is designed to have a predetermined curvature, such that the view angle is narrowed and the fluorescent film is excited at the periphery of the screen surface, thus distorting the formed image.

In order to solve these problems, a color cathode ray tube (CRT) having a flat-surface screen has been developed. In such a color CRT, a tension mask, in a state where a tensile force is applied thereto, is fixed to the inner surface of a panel so as to be separated by a predetermined distance from a fluorescent film formed on the inner surface of the panel. In this state, the panel is sealed with a funnel on which an electron gun and a deflection yoke are mounted.

Examples of a tension mask installed in a color CRT are respectively disclosed in U.S. Pat. No. 5,488,263, U.S. Pat. No. 4,973,283, U.S. Pat. No. 4,942,332, U.S. Pat. No. 4,926,089 and U.S. Pat. No. 6,097,142, for example.

An example of a tension mask, illustrative and exemplary of those disclosed in the aforementioned patents, is shown in FIG. 1. As shown in FIG. 1, the tension mask 20 has a plurality of strips 21 formed in parallel, and a slot 23 is formed by strips 21 and tie bars 22 having a vertical pitch PV, which connect the strips 21 to each other. Here, the vertical pitch PV of the tie bar 22 and the horizontal pitch PH of slots 23 are equal at the center portion of the tension mask 20 to those at the peripheral portion of the tension mask 20. The slots 23 have a plurality of auxiliary tie bars 24 which extend from a strip 21 on one side to an opposite strip side.

However, in a tension mask 20 having the auxiliary tie bars 24 as described above with respect to FIG. 1, as the vertical pitch PV of the tie bar 22 is relatively increased, a ligament ratio is correspondingly lowered. That is, referring to FIG. 2, the ligament ratio obtained by dividing the width W of the tie bar 22 by one of two equal parts PV into which the vertical pitch of a slot is divided. Thus, as the vertical pitch of a slot increases, the ligament ratio is relatively lowered.

As described above, when the ligament ratio is lowered, a supporting force between strips 21 is typically deteriorated, so that the tension mask 20 can be easily plastic-deformed by an impact applied from an external source, such as an impact applied in a vertical direction. That is, referring to FIGS. 1 and 2, a vibration, which is transmitted from the center to the periphery of the tension mask 20 when an impact is applied in the vertical direction of the tension mask 20, can cause a sudden increase in stiffness at a relatively-wide end strip area, which is the horizontal end of the tension mask 20, so that the edge of the tension mask is 20 plastic-deformed. This phenomenon occurs since an impact applied to the center portion is transmitted to the horizontal edge without reduction due to the fact that the vertical pitch of the tension mask 20 is the same at the center portion and the peripheral portion.

U.S. Pa. No. 4,926,089 to Moore, entitled Tied Slit Foil Shadow Mask With False Ties, discloses a front assembly for a color cathode ray tube that includes a glass faceplate that has on its inner surface a centrally disposed phosphor screen. A metal foil shadow mask is mounted in tension on a mask support structure located on opposed sides of the screen. The mask includes a series of parallel strips separated by slits, the strips being coupled by widely spaced ties. The mask has, between the strips, one or more false ties extending partially between, but not interconnecting, adjacent strips. The screen may also have spaced ties interconnecting the grille lines with a periodicity much smaller than that of the mask ties and below an observer's resolution threshold at normal viewing distances.

U.S. Pat. No. 4,942,332 to Adler et al., entitled Tied Slit Mask For Color Cathode Ray Tubes, discloses a slit-type foil tension mask and associated front assembly for a color cathode ray tube that includes a series of parallel strips separated by slits. The strips are loosely coupled by widely spaced ties, the wide tie spacing being such as to produce a strip coupling which promotes handleability of the mask during mask and tube fabrication, and which facilitates damping of strip vibration when mounted in a tube. Also, in FIG. 11 therein, it is disclosed that the vertical position, or pitch, of the ties is not constant but is randomly varied from tie to tie to suppress tie visibility. Also, in FIG. 12 therein, it is disclosed that false ties are placed along the slit edges at regular intervals between the real ties and with a pitch less than that of the real ties.

U.S. Pat. No. 4,942,333 to Knox, entitled Shadow Mask With Border Pattern, discloses a shadow mask adapted for tensioned mounting in a flat faced color CRT having a pattern of slits in the border regions of the mask disclosed to provide uniform distribution of tensile stresses across the mask when mounted in the CRT.

U.S. Pat. No. 4,973,283 to Adler et al., entitled Method Of Manufacturing A Tied Slit Mask CRT, discloses a slit-type foil tension mask and associated front assembly for a color cathode ray tube including parallel strips separated by slits. The strips are loosely coupled by widely spaced ties, the wide tie spacing being such as to produce a strip coupling which promotes handleability of the mask during mask and tube fabrication, and which facilitates damping of strip vibration when mounted in a tube.

U.S. Pat. No. 5,072,150 to Lee, entitled Shadow Mask Assembly for Color Picture Tube, discloses a shadow mask frame for a color picture tube that has side walls which are cut out to form cut-out sections, leaving only a plurality of bridge portions. A separate supporting means for the frame is provided in direct contact with the shadow mask.

U.S. Pat. No. 5,126,624 to Ji, entitled Color Cathode Ray Tube Having Improved Spring Type Contactor, discloses a color cathode ray tube having a spring type contactor. The spring type contactor effects electrical connection between a frame and a conductive coating deposited on the inner surface of the funnel, and comprises an '.OMEGA.' shaped fitting portion for being inserted into holes respectively perforated on the shield and the frame so as to be locked therein, a pair of legs abutting the edge of the hole of the shield, and a 'C' shaped contact portion extending from one of the legs to contact the conductive coating on the inner surface of the funnel.

U.S. Pat. No. 5,210,459 to Lee, entitled Shadow Mask Structure Of A Color Cathode Ray Tube, discloses a cathode ray tube with a shadow mask, the shadow mask structure being suspended and fixed behind the panel of the cathode ray tube. Plate springs for connecting the shadow mask structure and the panel are placed so as to apply pulling forces at either the sides or the corners of the shadow mask frame, and so as to hold the shadow mask to the skirt so as not to deform the shadow mask.

U.S. Pat. No. 5,488,263 to Takemura et al., entitled Color Selecting Electrode For Cathode-Ray Tube, discloses a color selecting electrode for use in a cathode-ray tube which includes a frame having a pair of opposed first supports and a pair of opposed second supports extending in a direction so as to cross the pair of first supports, and grid elements disposed on the pair of first supports at a fixed pitch and stretchedly bridging the pair of first supports.

U.S. Pat. No. 5,523,647 to Kawamura et al,. entitled Color Cathode Ray Tube Having Improved Slot Type Shadow Mask, discloses a color cathode ray tube having a slot type shadow mask. The shadow mask assembly is suspended inside the panel, and is disclosed as including a mask frame, and the shadow mask held on the mask frame, the shadow mask having a large number of grilles and bridges disposed at an interval for connecting adjacent grilles, the grilles and the bridges having sections which are concave in opposite directions, respectively.

U.S. Pat. No. 5,534.746 to Marks et al., entitled Color Picture Tube Having Shadow Mask With Improved Aperture Spacing, discloses a color picture tube that includes a shadow mask and a dot screen, wherein the mask is rectangular and has two horizontal long sides and two vertical short sides. The long sides are parallel to a central major axis of the mask and the short sides are parallel to a central minor axis of the mask. The mask includes an array of apertures arranged in vertical columns and horizontal rows. Apertures in one row are disclosed as being in different columns than are the apertures in adjacent rows. The vertical spacing between apertures in the same column is the vertical pitch of the apertures, and the horizontal spacing between apertures in the same row is the horizontal pitch of the apertures. It is disclosed that the horizontal pitch of the apertures increases from the minor axis to the short side of the masks and decreases from the major axis to the long sides of the mask. Also, along the major axis, the vertical pitch of the mask is disclosed as decreasing from the center to the short sides of the mask and, adjacent the long sides of the mask, it is disclosed as increasing from the minor axis to the corners of the mask.

U.S. Pat. No. 6,057,640 to Aibara, entitled Shadow Mask For Color Cathode Ray Tube With Slots Sized to Improve Mechanical Strength And Brightness, discloses a shadow mask for a cathode ray tube, including a plate having a first surface and a second surface. The plate is formed with at least one line of slots between which bridge portions are formed, each slot being spaced away from adjacent slots by a predetermined pitch. The bridge portions are defined by a first length at the first surface of the plate and a second length at the second surface of the plate, the first and second lengths being determined so that a factor is in the range of 5% to 15%, the factor being defined as a ratio of the smaller of the first and second lengths to the predetermined pitch.

U.S. Pat. No. 6,072,270 to Hu et al., entitled Shadow Mask For Color CRT, discloses a shadow mask employed as a color selection electrode in a multi-electron beam color cathode ray tube (CRT), the surface area of the mask being reduced by increasing the length of the individual elongated beam passing apertures, or slots, while-reducing the ratio of the width of the bridge portion of the mask between adjacent apertures to the length of the aperture.

U.S. Pat. No. 6,097,142 to Ko, entitled Shadow Mask Having An Effective Face Area And Ineffective Face Area, discloses a shadow mask including an effective face area constituting a central portion of the shadow mask. The effective face area has electron beam apertures, which electrons pass through. A secondary ineffective face area surrounds the effective face area and also has apertures. A frame attaching border further surrounds the secondary ineffective face area, and a primary ineffective face area at least partially surrounds the frame attaching border. Corners of the shadow are adjacent to the primary ineffective face area and do not have apertures. It is disclosed that portions of the primary and/or secondary ineffective areas are treated with tie bar grading and/or have round corners.

SUMMARY OF THE INVENTION

To promote resolving the above problem, an objective, among other objectives, of the present invention is to provide a tension mask frame assembly for a color cathode ray tube, by which a tension mask is prevented from being plastic-deformed by a tensile force applied to the tension mask or by a strong impact applied from an external source.

To achieve the above objective and other objectives of the present invention, the present invention provides a tension mask frame assembly for a color cathode ray tube including: a tension mask having a plurality of strips on which slots are formed, the slots being separated by a predetermined distance from each other on a thin plate, and real bridges for partitioning slots at a predetermined pitch interval by connecting adjacent ones of the plurality of strips to each other; and a frame which supports the corresponding edges of the tension mask, whereby the vertical pitch of the real bridges becomes smaller, such as in a stepwise relation, in a direction from the center portion of the tension mask to the peripheral portion of the tension mask, with a vertical pitch of the plurality of real bridges in the center portion of the tension mask being greater than a vertical pitch of the plurality of real bridges in a peripheral portion of the tension mask.

Also, in the present invention, the tension mask desirably includes a dummy bridge that extends from a strip on at least one side of a corresponding slot to a strip on the opposite side of the corresponding slot, the dummy bridge being formed on a slot partitioned by a corresponding one of the real bridges.

Also, to achieve the above objective and other objectives of the present invention, the present invention provides a tension mask frame assembly for a color cathode ray tube including: a tension mask having a plurality of strips on which slots are formed, the slots being separated by a predetermined distance from each other on a thin plate, and real bridges for partitioning slots at a predetermined pitch interval by connecting adjacent ones of the plurality of strips to each other; and a frame which supports the corresponding edges of the tension mask, whereby a tensile force is applied to the tension mask, and the vertical pitch of the real bridges becomes smaller at both shorter sides of the tension mask than at the center portion of the tension mask.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
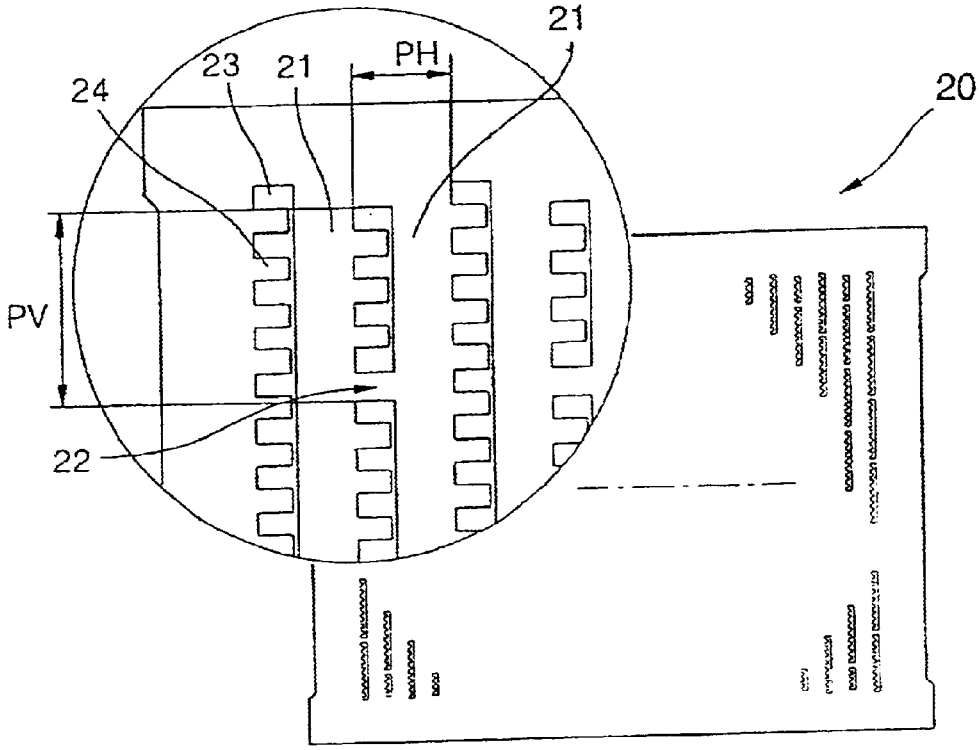
Fig. 1 (Prior Art)
FIG. 1 is a plan view of a conventional tension mask of a color cathode ray tube.
Figure 2:
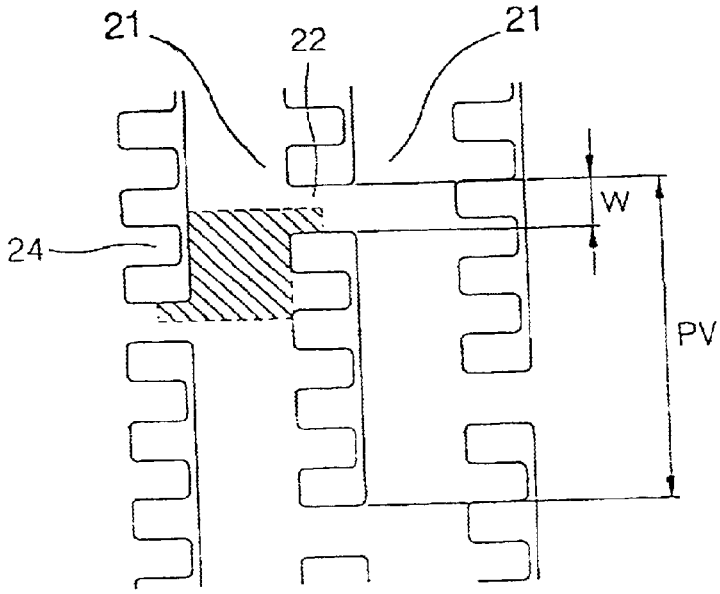
Fig. 2 (Prior Art)
FIG. 2 is a magnified view of part of the tension mask shown in FIG. 1.
Figure 3:
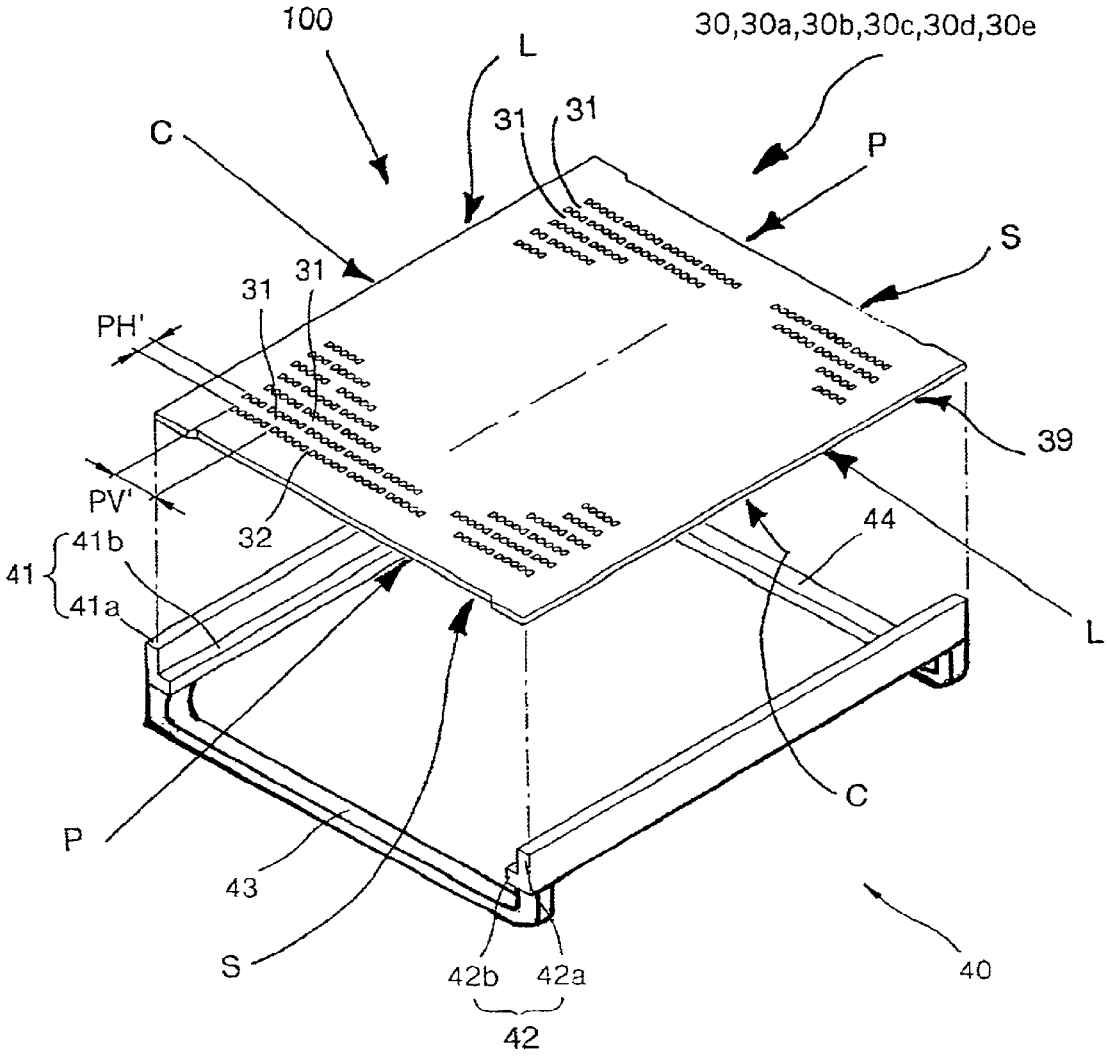
FIG. 3 is an exploded perspective view of a tension mask frame assembly for a color cathode ray tube according to an embodiment of the present invention.
Figure 4:
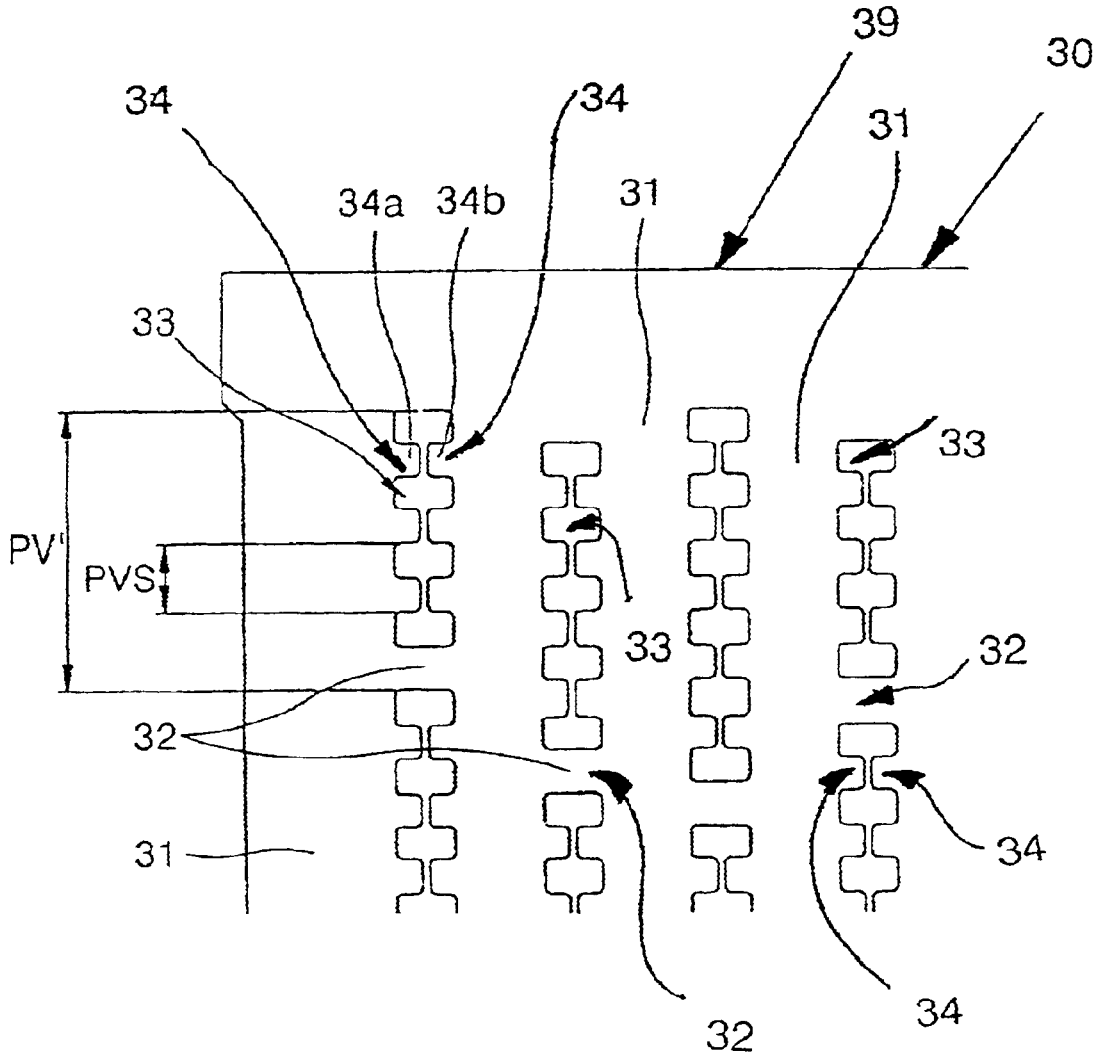
FIG. 4 is a plan view of a tension mask shown in FIG. 3.

Referring to FIGS. 3 and 4, a tension mask frame assembly 100 for a color cathode ray tube according to an embodiment of the present invention includes a tension mask 30, 30*a*–30*e* which can distinguish the colors of an electron beam, and a frame 40 for supporting the tension mask 30, 30*a*–30*e* so that the tension mask 30, 30*a*–30*e* has a predetermined tensile force. The tension mask 30, 30*a*–30*e* has a plurality of strips 31 formed on a thin plate 39 so as to be isolated a predetermined distance from each other, and a plurality of slots 33 formed by connecting the adjacent strips 31 to a real bridge 32 having a predetermined vertical pitch PV'. The strips 31 and the real bridges 32 are formed by etching the thin plate 39, for example. The predetermined vertical pitch PV' of the real bridges 32, which defines the slots 33 by connecting adjacent strips 31 of the tension mask 30, 30*a*–30*e* to each other, becomes smaller, such as in a stepwise manner, in a direction from the center portion C to the peripheral portion P of the tension mask 30, 30*a*–30*e*. Thus, the number of real bridges 32 gradually increases in the direction from the center portion C to the peripheral portion P of the tension mask 30.

Figure 5:
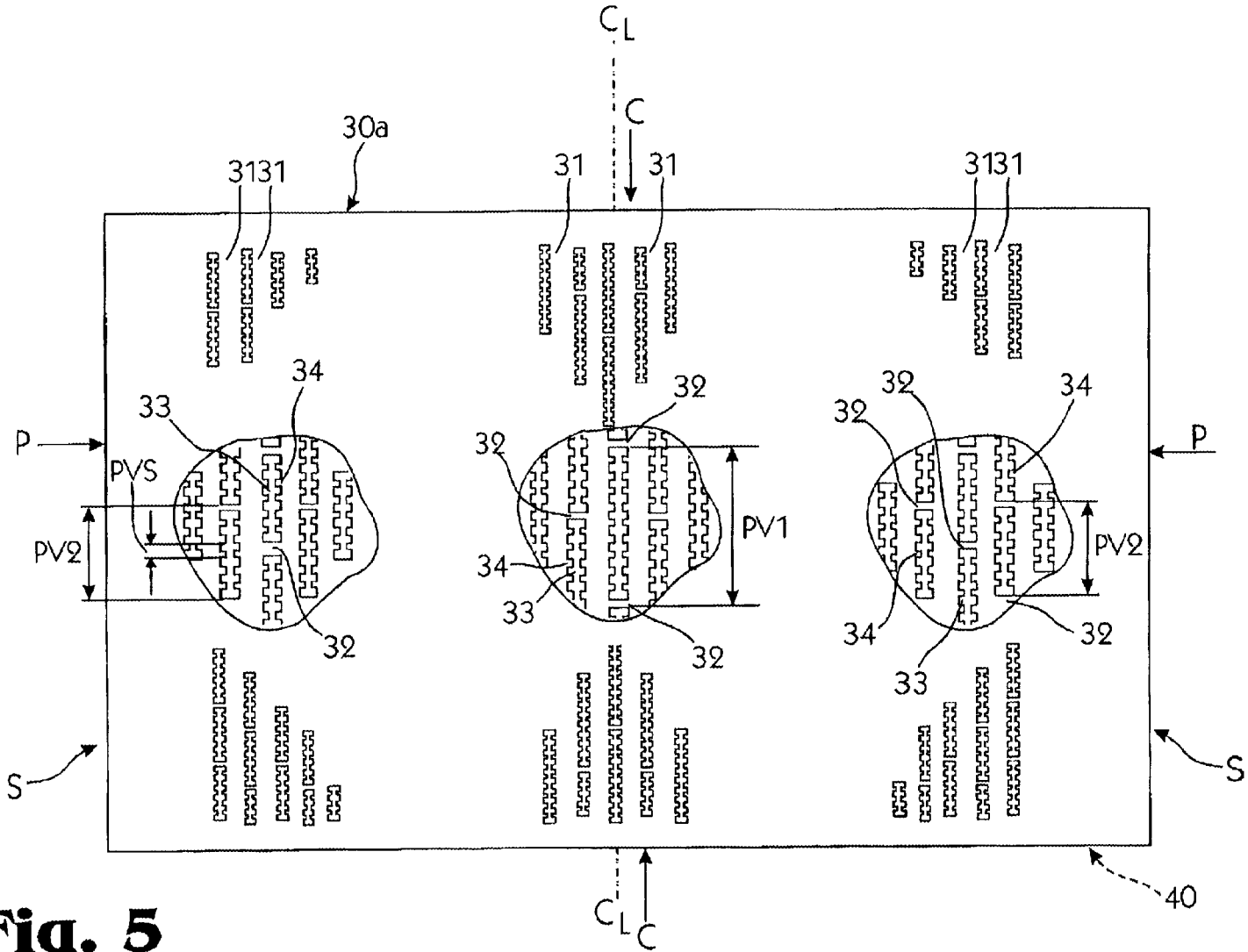
FIG. 5 is a plan view of a tension mask of a tension mask frame assembly for a color cathode ray tube according to another embodiment of the present invention, whereby the vertical pitch of a real bridge is smaller at both shorter sides of the tension mask than at the center portion of the tension mask.

Also, a tension mask frame assembly 100 according to another embodiment of the present invention is illustrated in FIG. 5. The tension mask frame assembly 100 of FIG. 5 includes a tension mask 30*a*. In the tension mask 30*a*, as to the vertical pitches PV1 and PV2 of the real bridges 32, which connect adjacent strips 31 of the tension mask 30*a* to each other, the vertical pitches PV2 at both shorter sides S of the tension mask 30*a* are smaller than the vertical pitch PV1 at the center portion C of the tension mask 30*a*, as shown in FIG. 5. In this embodiment of FIG. 5, it is natural that the number of real bridges 32, which respectively connect five (5) to nine (9) strips 31 to each other, for example, and which are placed at the edge of both shorter sides S of the tension mask 30*a*, is greater in number than that of the real bridges 32 at the center portion C of the tension mask 30*a*, with the center of tension mask 30*a* being indicated by the center line $C_L$.

Figure 6:
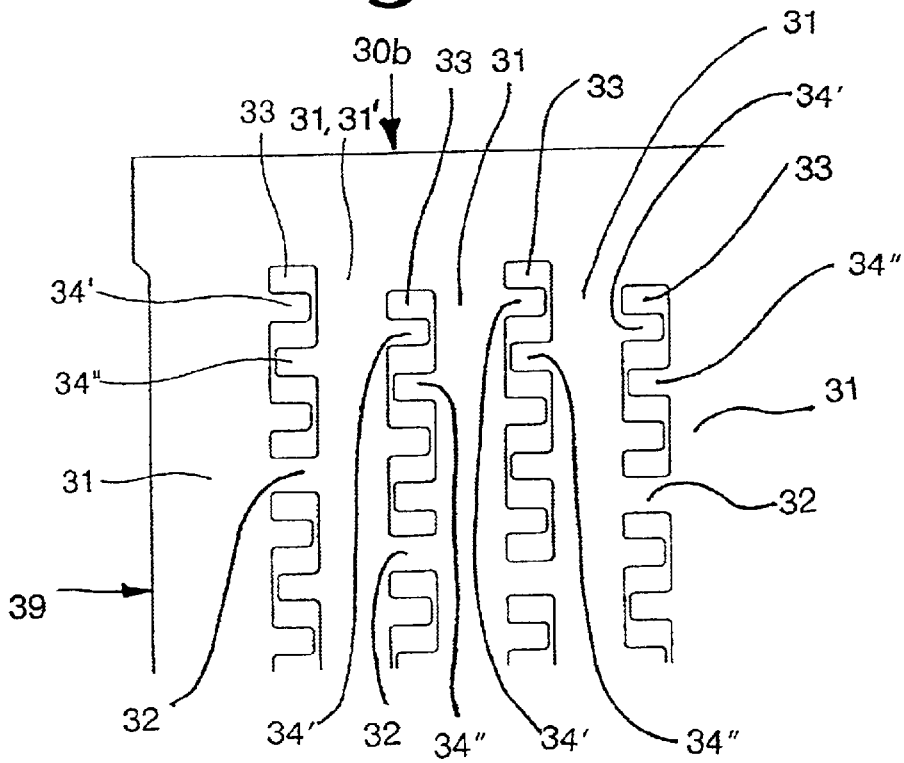
FIG. 6 is a plan view of another embodiment of a tension mask according to the present invention.
Figure 7:
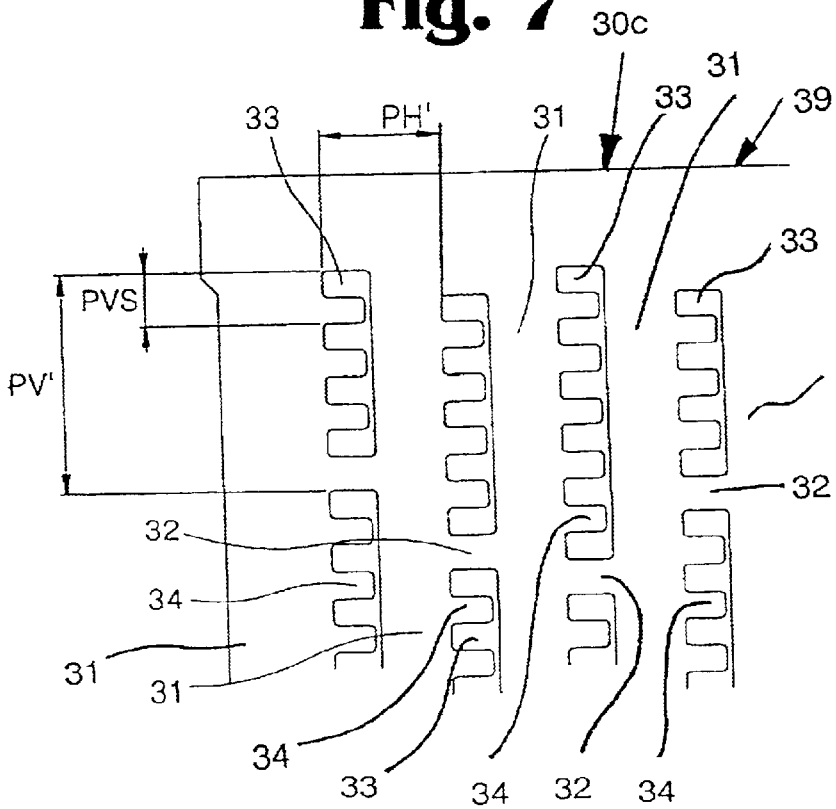
FIG. 7 is a plan view of a further embodiment of a tension mask according to the present invention.

Further, FIGS. 6 and 7 illustrate other embodiments of a tension mask according to the present invention. FIG. 6 illustrates a tension mask 30*b* having a plurality of strips 31 on a thin plate 39, a plurality of real bridges 32, and a plurality of slots 33 as can be used in tension mask assembly 100 of FIG. 3. Also, FIG. 7 illustrates a further embodiment of a tension mask 30*c* having a plurality of strips 31 on a thin plate 39, a plurality of bridges 32, and a plurality of slots 33 as can be used in tension mask assembly 100 of FIG. 3.

Referring to FIGS. 4 through 9B, dummy bridges 34, 34', 34" extending from a strip 31 on at least one side of a strip 31 are placed on a slot 33 defined by adjacent strips 31 and a corresponding real bridge 32 of the tension mask 30, 30*a*, 30*b*, 30*c*, 30*d*, 30*e*, and the slot 33 is partitioned by the dummy bridges 34 at intervals of a predetermined vertical pitch PVS. As shown in FIG. 4, for example, a dummy bridge 34 positioned at a slot 33 is made up of protrusions 34*a* and 34*b* extending in opposite directions from adjacent strips 31 on both sides of the corresponding slot 33. Alternatively, as shown in FIG. 6, a dummy bridge 34', extends from a strip 31 on one side to an opposite strip side of an adjacent strip 31, 31', and an adjacent dummy bridge 34" extends from the adjacent strip 30, 31' on the other side, such that the dummy bridges 34' and 34" alternate. Also, as shown in FIG. 7, dummy bridges 34 can extend from a strip 31 on one side to an opposite strip side of an adjacent strip 31 in a corresponding slot 33.

Also, as illustrated in FIG. 4, for example, it is preferable that the dummy bridges 34 adjacent to a slot 33 are in a staggered relation with respect to dummy bridges 34 adjacent to an opposing slot 33.

Further, in a case where the dummy bridges 34 are each made up of the protrusions 34*a* and 34*b* extending from strips 31 on both sides of a slot, it is preferable that the end of the protrusions 34*a* not contact the end of the protrusion 34*b*, such as is illustrated in FIG. 4, for example.

In the tension masks 30, 30*a* through 30*c* described above, the vertical pitch PVS of a slot divided by the real bridge 32 and each of the corresponding dummy bridges 34, 34' and 34" is equal, at the center portion C of the tension mask, to that at the peripheral portion P thereof. However, undoubtedly, the vertical pitch PVS of a slot defined by the real bridge 32 and the dummy bridge 34, 34', 34" can become larger in the direction from the center portion C to the peripheral portion P in consideration of the deflection angle of an electron beam emitted from an electron gun. Also, the horizontal pitch PH' of the slots 33 formed by the strips 31 of the tension masks 30, 30*a* through 30*e* can be controlled according to an angle at which an electron beam is deflected by the deflection yoke. When considering the landing allowance of an electron beam, it is preferable that the horizontal pitch PH' of the slots 33 increase in a direction from the center C to the periphery P of the tension masks 30, 30*a* through 30*e*.

Referring again to FIG. 3, in the tension mask frame assembly 100, the frame 40 has a configuration to support the tension mask, such as tension masks 30, 30*a* through 30*e*, and includes support members 41 and 42 for supporting the long or longer sides L of the tension mask, and elastic members 43 and 44 which connect the support members 41 and 42 to each other and have elastic forces. The support members 41 and 42 includes supporters 41*a* and 42*a* which are welded with the longer sides L of the tension mask 30, 30*a* through 30*e*, respectively, and flanges 41*b* and 42*b* extending inwardly from the supporters 41*a* and 42*a*, respectively. However, a frame, such as frame 40, is not limited by the above embodiment, such as is illustrated in FIG. 3. Any kind of frame can be used as long as it does not diminish the effective screen when mounted on a panel, and so long as it can support a tension mask, such as tension masks 30, 30*a* through 30*e*, in a state where a tensile force has been applied thereto.

Continuing with reference to FIG. 3, an example of a tensile force or a tensile strength applied to tension mask 30, 30*a* through 30*e* is described as follows. Typically, frame 40 supports the tension mask 30, 30*a* through 30*e* so that the tension mask can receive a uniform tensile force in one direction, such as in the "Y axis" direction. In the tension mask frame assembly 100, when the support members 41 and 42 are pressed in opposite directions, the elastic members 43 and 44 supporting the support members 41 and 42 are elastically deformed, since the longer sides L of the tension mask 30, 30*a* through 30*e* are welded at the supporters 41*a* and 42*a* of the support members 41 and 42, and a tensile force is applied to the tension mask 30, 30*a* through 30*e* in a lengthwise direction of the strips 31.

The tension mask frame assembly, such as tension mask frame assembly 100, having a configuration according to the present invention as described above, is mounted on a color cathode ray tube, and can distinguish the colors of an electron beam emitted from an electron gun in order to allow the electron beam to accurately land on corresponding fluorescent materials. As for the tension masks 30, 30*a* through 30*e*, its longer sides L are supported by the support members 41 and 42 while its shorter sides S are not supported by the frame 40, so that the shorter sides S of the tension mask are more likely than the longer sides to be vibrated by an external impact However, in the tension masks according to the present invention, such as tension masks 30, 30*a* through 30*e*, the vertical pitch PV' of the real bridge 32, which connects the strips 31 to each other, becomes narrower in a direction from the center portion C to the peripheral portion P of the tension mask on the shorter sides S, or is smaller at the peripheral portion P of both shorter sides S of the tension mask than at the center portion C of the tension mask, such that the ligament ratio gradually increases in a direction from the center portion C to the peripheral portion P of the tension mask 30, 30*a* through 30*e*. The stiffness of the tension mask 30, 30*a* through 30*e* also gradually increases from the center portion C to the peripheral portion P of the tension mask such that, even if a large impact is applied to the center portion C of the tension mask, this impact is gradually weakened while being transmitted in the horizontal direction of the tension mask, and finally disappears at an end strip portion existing at the horizontal edge of the tension mask. Thus, plastic deformation of the edge of the tension mask can be substantially prevented. Also, at the peripheral portion P of the tension mask, the vertical pitch PV' of the real bridge 32 connecting strips 31 to each other is narrow, such that the supporting force between the strips 31 is improved.

Figure 8A:
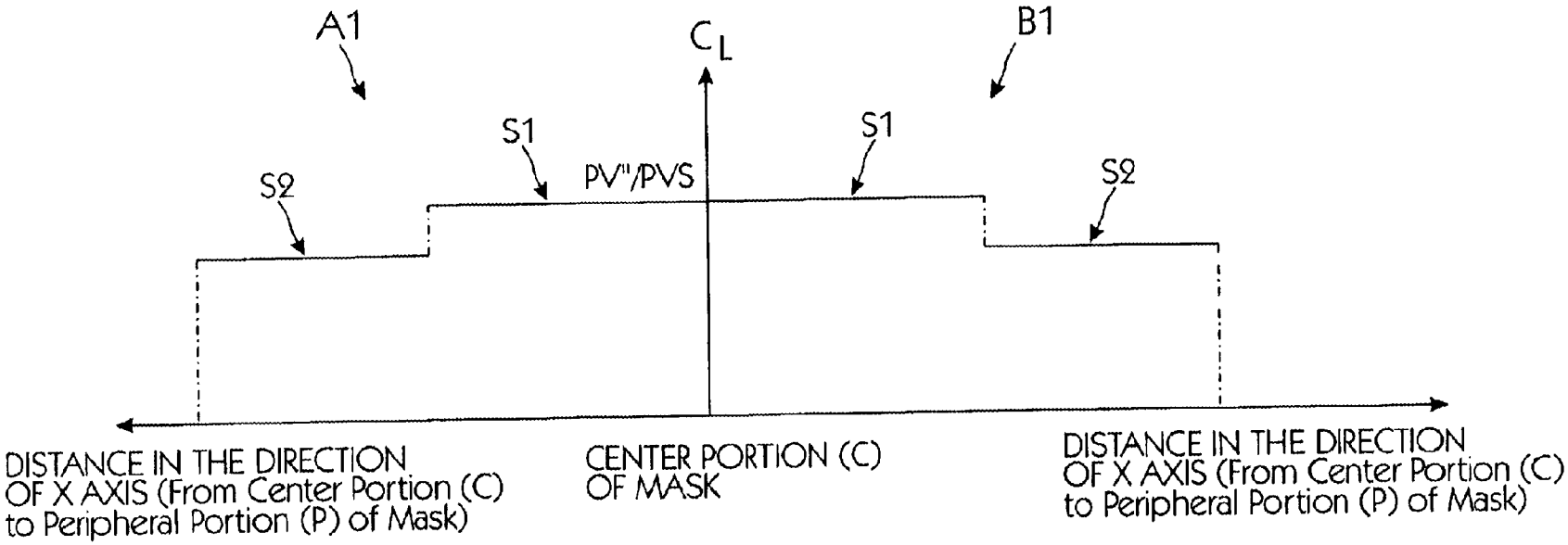
FIGS. 8A and 8B are graphs showing the relationship between and relating to the vertical pitch of a real bridge at the center portion of types of further embodiments of a tension mask according to the present invention and the vertical pitch of the real bridge at and moving toward both shorter sides of the tension mask.
Figure 8B:
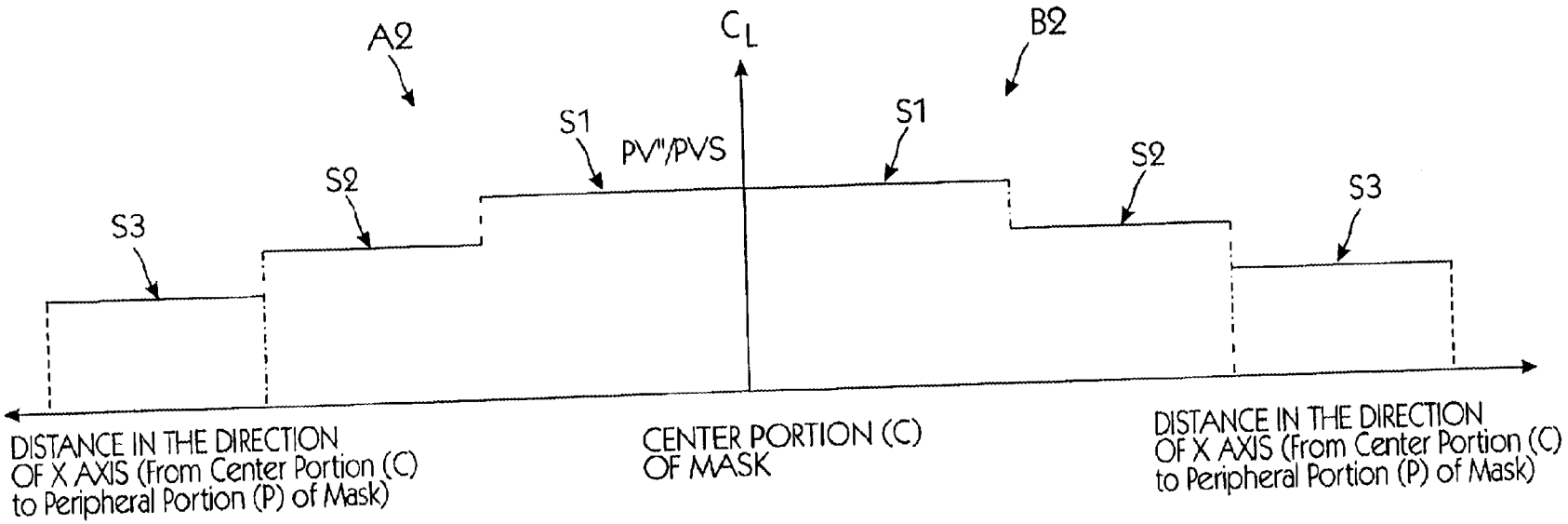
Figure 9A:
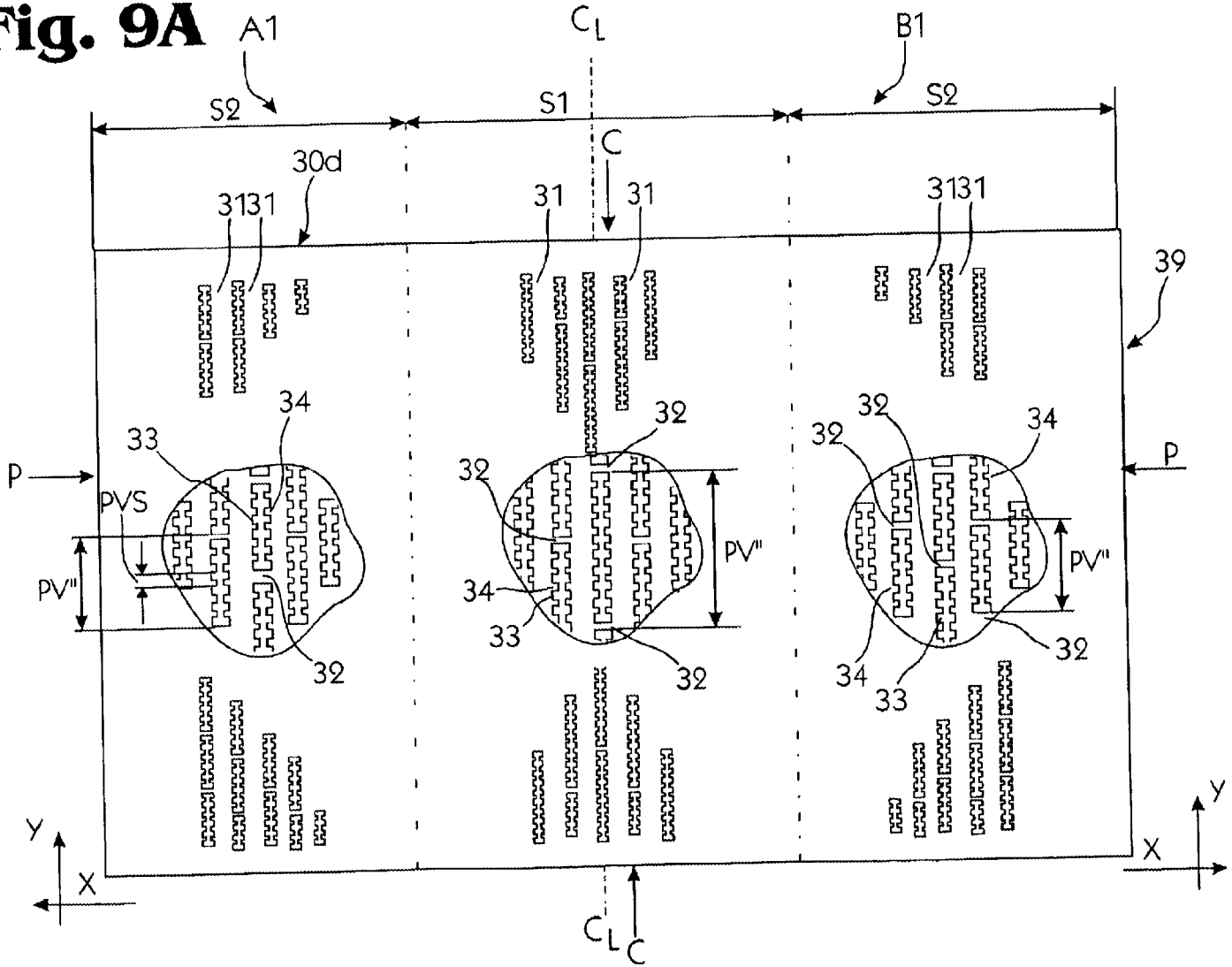
FIGS. 9A and 9B are plan views, for types of the further embodiments, referred to in FIGS. 8A and 8B, of tension masks according to the present invention.
Figure 9B:
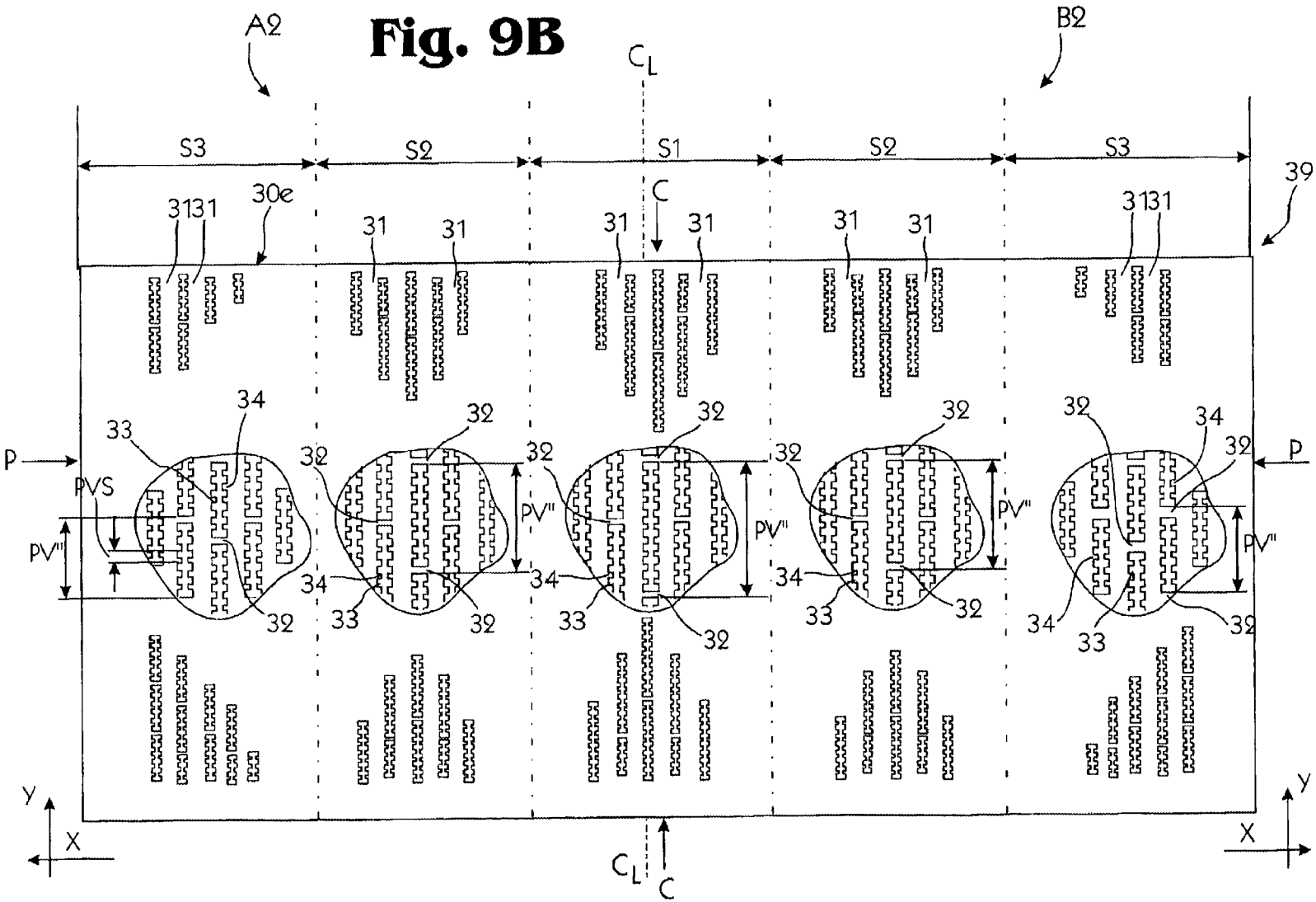

FIGS. 8A, 8B, 9A and 9B illustrate further embodiments of tension masks 30*d* and 30*e* of such a type, that they can be used in tension mask frame assembly 100 (FIG. 3) according to the present invention. As shown in FIGS. 9A and 9B, respectively, each of tension masks 30*d* and 30*e* has a plurality of strips 31 formed on a thin plate 39 so as to be isolated by a predetermined distance from each other, and a plurality of slots 33 formed by connecting the adjacent strips 31 to a real bridge 32 having a respective predetermined vertical pitch PV". The predetermined vertical pitch PV" of the real bridges 32, which define the slots 33 by connecting adjacent strips 31 of the tension mask 30*d*, 30*e* to each other, decreases in steps and in a stepwise relation in a direction from the center portion C of the tension mask 30*d*, 30*e* to the peripheral portion P of the tension mask 30*d*, 30*e*, such as in the X axis direction illustrated in FIGS. 8A through 9B. That is, in the embodiment of the tension mask 30*d* of FIG. 9A, the tension mask 30*d* is partitioned into a first region S1 including at least the center portion C and second regions S2 adjacent to the first region S1, and the vertical pitch PV" of the real bridges 32 at the second regions S2 of the tension mask 30*d* is smaller than that of the real bridges 32 at the first region S1 of the tension mask 30*d*. Dummy bridges 34 extending from a strip 31 on at least one side of a strip 31 are formed on a slot 33 defined by adjacent strips 31 and a corresponding real bridge 32 in each of the first and second regions S1 and S2, at intervals of a predetermined vertical pitch PVS. The dummy bridges 34 are similar to the dummy bridges 34 in the above-described embodiments of FIGS. 4 through 7.

Continuing with reference to FIGS. 8A, 8B, 9A and 9B, the number of dummy bridges 34 formed on a slot 33, defined by adjacent strips 31 and a real bridge 32, is smaller in the second regions S2 than in the first region S1. To be more specific, in the tension mask 30*d*, 30*e* of FIGS. 9A and 9B, for example, a value obtained by dividing the vertical pitch PV" of the real bridges 32 by the vertical pitch PVS of the dummy bridges 34 is referred to as M, the value M being smaller in the second regions S2 than in the first region S1, and the value of M being smaller in the regions S3 than in the regions S2 of FIG. 9B. The value M is an integer that satisfies an expression of inequality: $3 \leqq M \leqq 29$. For example, a value obtained by dividing the vertical pitch PV" of the real bridges 32 by the vertical pitch PVS of the dummy bridges 34 in the first region S1 is M, and a value obtained by dividing the vertical pitch PV" of the real bridges 32 by the vertical pitch PVS of the dummy bridges 34 in the second regions S2 is M-n. Here, the value n is an integer that satisfies an expression of inequality: 0<n<M, where n is greater than zero (0) and smaller than 29. Therefore, in a type of tension mask 30*d*, 30*e* including a plurality of regions, such as regions S1 and S2 of the tension mask 30*d* of FIG. 9A or regions S1, S2 and S3 of the tension mask 30*e* of FIG. 9B, with a region, such as region S1, of the plurality of regions having a value M obtained by dividing the vertical pitch of corresponding ones of real bridges 32 in the region by the vertical pitch of corresponding ones of the dummy bridges 34 in the region, an adjacent region, such as region S2, to the region has a value M-n obtained by dividing the vertical pitch of corresponding ones of the real bridges 32 in the adjacent region by the vertical pitch of corresponding ones of dummy bridges 34 in the adjacent region, with n being a value greater than zero and less than M.

The above described decreasing stepped or stepwise relation of the predetermined vertical pitch PV" is also evident from the relation PV"/PVS, as illustrated in FIGS. 8A and 8B. In the case of the tension mask 30*d* of FIGS. 8A and 9A, two regions S1 and S2 having different numbers of dummy bridges 34 are taken as an example and described, with the decreasing stepwise relation for the regions S1 and S2 of tension mask 30*d* of FIG. 9A being illustrated in FIG. 8A. However, the number of regions having different numbers of dummy bridges 34 is not limited to two, and the tension mask can be partitioned into a plurality of regions, such as two or more regions, such as regions S1, S2, S3 of tension mask 30*e* of FIGS. 8B and 9B, with the above described decreasing stepped or stepwise relation for these regions S1, S2 and S3 of tension mask 30*e* of FIG. 9B being illustrated in FIG. 8B.

Also, the number of dummy bridges 34 within or adjacent to a slot 33, that is defined by adjacent strips 31 and adjacent real bridges 32, can decrease in steps or in a stepwise relation in the direction (X axis direction (FIGS. 8A through 9B)) from the center portion C to the peripheral portion P of the tension mask, while each of the slots 33 in a corresponding region, such as in a region S1, S2, or S3, can have the same number of dummy bridges 34. That is, the value M can decrease in steps or in a stepwise relation in the direction from the center portion C to the peripheral portion P of the tension mask, such as tension mask 30*d*, 30*e*, while a decrease is made in units of dummy bridges 34 of respective regions, such as regions S1 and S2 of FIG. 9A or regions S1, S2 and S3 of FIG. 9B. Also, the frame 40, which supports the tension mask 30*d*, 30*e* of FIGS. 9A and 9B, such as is illustrated in FIG. 3, is similar to that used to support tension masks 30, 30*a*, 30*b*, and 30*c*, for example, in the above-described embodiments, but it is not restricted to these embodiments.

In the tension mask 30*d*, 30*e* of FIGS. 9A and 9B according to the present invention, the vertical pitch PV" of a real bridge 32, which connects adjacent strips 31 to each other, decreases in steps or in a stepwise relation in a direction, such as the X axis direction (FIGS. 8A–9B), from the center portion C to the peripheral portion P of the tension mask 30*d*, 30*e*, such that the supporting force between strips and the stiffness of the tension mask 30*d*, 30*e*, gradually increase from the center portion C to the peripheral portion P of the tension mask 30*d*, 30*e*. Also, the number of dummy bridges 34 extending from strips 31 within a slot 33, defined by adjacent strips 31 and adjacent real bridges 32, decreases in steps or in a stepwise relation, so that the vibration of the tension mask, such as tension mask 30*d*, 30*e*, can be reduced.

Further, as illustrated in FIGS. 9A and 9B, and as discussed previously with respect to FIG. 4, for example, it is preferable that the dummy bridges 34 adjacent to a slot 33 are in a staggered relation with respect to dummy bridges 34 adjacent to an opposing slot 33.

Also, as illustrated in FIGS. 8A, 8B, 9A and 9B, it is preferable that the stepwise relation be symmetrical for corresponding opposing side portions or corresponding opposing portions of the tension mask, such as tension masks 30*d* and 30*e*, from a center portion C to the peripheral portion P of the tension mask, such as tension masks 30*d* and 30*e*. As illustrated in FIGS. 8A through 9B, the center of the tension mask 30*d*, 30*e* is indicated by the center line $C_L$. In FIGS. 8A and 9A, the center line $C_L$ divides the tension mask 30*d* into opposing side portions A1 and B1, and in FIGS. 8B and 9B the center line $C_L$ divides the tension mask 30*e* into opposing side portions A2 and B2, as illustrated in FIGS. 8A through 9B, respectively. As illustrated in FIGS. 8A through 9B, the respective portion A1 or A2 of the tension mask 30*d*, 30*e* located to one side of the center or center line $C_L$ of the tension mask 30*d*, 30*e* is respectively symmetrical to the corresponding portion B1 or B2 respectively located to the opposing side of the center line $C_L$ of the tension mask 30*d*, 30*e*.

Also, as is evidenced from FIGS. 8A and 8B respectively corresponding to the tension masks 30*d* and 30*e* of FIGS. 9A and 9B, with respect to the center of the tension mask 30*d*, 30*e* in the direction from the center portion C to the peripheral portion P, in each of opposing directions from the center or center line $C_L$, the relation PV"/PVS and to the relation of the vertical pitch of the real bridges 32 is in a relation, such as a stepwise relation, that is symmetrical for corresponding opposing sides A1 and B1 of tension mask 30*d* of FIG. 9A, and for corresponding opposing sides A2 and B2 of tension mask 30*e* of FIG. 9B. Further, as illustrated in FIGS. 8A through 9B, corresponding regions S1, S2 or S1, S2, S3 in opposing portions or opposing side portions A1 and B1 of tension mask 30*d* of FIGS. 8A and 9A, and in opposing portions or opposing side portions A2 and B2 of tension mask 30*e* of FIGS. 8B and 9B, are symmetrical with respect to each other, and are also symmetrical with respect to the relation PV"/PVS and with respect to the relation of the vertical pitch of the real bridges 32, such as the symmetrical stepwise relation illustrated in FIGS. 8A and 8B.

Therefore, in summary, in the tension masks 30*d* and 30*e* of FIGS. 9A and 9B, opposing side portions or portions A1, B1 of the tension mask 30*d* and opposing side portions or portions A2, B2 of the tension mask 30*e* are symmetrical with respect to each other, as illustrated in FIGS. 9A and 9B, and also are symmetrical with respect to the vertical pitch relation of real bridges 32 and with respect to the PV"/PVS relation, such as in the symmetrical stepwise relation illustrated in FIGS. 8A and 8B. Also, with respect to the region S1 in the tension masks 30*d* and 30*e* of FIGS. 9A and 9B, the portion of the region S1 in the portion A1 is symmetrical with respect to the portion of the region S1 in the portion B1 of the tension mask 30*d*, and the portion of the region S1 in the portion A2 is symmetrical with the portion of the region S1 in the portion B2 of the tension mask 30*e*, as illustrated in FIGS. 8A through 9B, as well as being symmetrical in the relation of the vertical pitch of the real bridges 32 and in the stepwise relation. The respective symmetry in the tension masks 30*d* and 30*e* of FIGS. 9A and 9B is also evidenced from these FIGS. 9A and 9B in the symmetrical relation of the strips 31, real bridges 32 and dummy bridges 34, and the corresponding opposing side portions A1 and B1 and A2 and B2 divided by the center or center line $C_L$ of the respective tension masks 30*d* and 30*e*.

The above-described advantages of tension masks according to the present invention, such as those of the type of tension masks 30*d* and 30*e* of FIGS. 8A through 9B, will be more clarified through the following experimental examples. The following experimental examples respectively use tension masks of the type of tension mask 30*d*, 30*e* of FIGS. 8A through 9B, with the tension mask of the third experimental example including an M value of 30 to contrast the preferred range of $3 \leqq M \leqq 29$. However, the present invention is not limited to the following experimental examples.

First Experimental Example

A tension mask was manufactured, having a first region which is positioned at the center of a slotted portion of the tension mask and in which a value M obtained by dividing the pitch of a real bridge by the pitch of a dummy bridge is 9, and second regions which are positioned at both lateral sides of the center (in the X axis direction) and have a value M of 7, in which the difference in the value M between the first and second regions is 2. In a state where a tensile force is being applied to the tension mask by being supported by a frame, the vibration decay time and maximum amplitude at predetermined locations from the center portion to the peripheral portion of the tension mask were measured, with the results illustrated in Table 1. In Table 1, the maximum amplitude denotes the maximum amplitude at each location during initial vibration, and the decay time denotes the time during which each location has 10% of the maximum amplitude.

TABLE 1

| Distance from the center of a mask (mm) | 0 | 150 | 200 | 250 | 290 |
|---|---|---|---|---|---|
| Decay time (sec) | 2.3 | 2.8 | 1.9 | 1.9 | 1.0 |
| Maximum amplitude (μm) | 37.0 | 43.0 | 41.0 | 57.0 | 59.0 |

Second Experimental Example

A tension mask was manufactured, having a first region which is positioned at the center of a slotted portion of the tension mask and in which a value M obtained by dividing the pitch of a real bridge by the pitch of a dummy bridge is 13, and second regions and third regions which are respectively positioned at both lateral sides of the center (in the X axis direction) and, respectively, have a value M of 7 and a value M of 5, in which the difference in the value M between the first and second regions is 6 and the difference in the value M between the second regions and third regions is 5. In a state where the tension mask is supported by a frame so that a tensile force is applied to the tension mask, the vibration decay time and maximum amplitude at predetermined locations from the center portion to the peripheral portion of the tension mask were measured, with the results illustrated in Table 2.

TABLE 2

| Distance from the center of a mask (mm) | 0 | 100 | 150 | 200 | 250 | 290 |
|---|---|---|---|---|---|---|
| Decay time (sec) | 5.3 | 4.0 | 4.3 | 5.2 | 2.4 | 1.1 |
| Maximum amplitude (μm) | 170 | 165 | 150 | 135 | 135 | 100 |

Third Experimental Example:

A tension mask was manufactured, having a first region which is positioned at the center of a slotted portion of the tension mask and in which a value M obtained by dividing the pitch of a real bridge by the pitch of a dummy bridge is 30, and second regions and third regions which are positioned respectively at both lateral sides of the center (in the X axis direction) and, respectively, have a value M of 25 and a value M of 20, in which the difference in the value M between the first region and the second regions is 56. Here, the second regions and the third regions have a width of 5 to 10 mm, which is measured from each of the shorter sides of the tension mask. In a state where the tension mask is supported by a frame so that a tensile force is applied to the tension mask, the vibration decay time and maximum amplitude at predetermined locations from the center portion to the peripheral portion of the tension mask were measured, with the results illustrated in Table 3.

TABLE 3

| Distance from the center of a mask (mm) | 0 | 100 | 150 | 200 | 250 | 290 |
|---|---|---|---|---|---|---|
| Decay time (sec) | 23.0 | 25.5 | 21.0 | 20.5 | 21.0 | 19.5 |
| Maximum amplitude (μm) | 250 | 240 | 210 | 200 | 185 | 180 |

Fourth Experimental Example:

A tension mask was manufactured, having a first region which is positioned at the center of a slotted portion of the tension mask and in which a value M obtained by dividing the pitch of a real bridge by the pitch of a dummy bridge is 11, and second regions which are positioned at both lateral sides of the center (in the X axis direction) is and have a value M of 7, in which the difference in the value M between the first and second regions is 4. In a state where a tensile force is being applied to the tension mask by being supported by a frame, the vibration decay time and maximum amplitude at predetermined locations from the center portion to the peripheral portion of the tension mask were measured, with the results illustrated in Table 4.

TABLE 4

| Distance from the center of a mask (mm) | 0 | 100 | 150 | 200 | 250 | 290 |
|---|---|---|---|---|---|---|
| Decay time (sec) | 5.2 | 6.5 | 7.4 | 5.7 | 4.3 | 1.7 |
| Maximum amplitude (μm) | 96 | 95 | 70 | 60 | 65 | 45 |

First Comparative Example:

A tension mask was manufactured, having only a first region which is positioned at the center of a slotted portion of the tension mask and in which a value M obtained by dividing the pitch of a real bridge by the pitch of a dummy bridge is 11. In a state where the tension mask is supported by a frame so that a tensile force is applied to the tension mask, the vibration decay time and maximum amplitude at predetermined locations from the center portion to the peripheral portion of the tension mask were measured, with the results illustrated in Table 5.

TABLE 5

| Distance from the center of a mask (mm) | 0 | 150 | 200 | 250 | 290 |
|---|---|---|---|---|---|
| Decay time (sec) | 3.2 | 8.0 | 9.8 | 9.8 | 8.3 |
| Maximum amplitude (μm) | 38.0 | 70.0 | 87.0 | 103.0 | 57.8 |

In the tension masks according to the above described first through fourth experimental examples, the decay time of a vibration rapidly decreased and the amplitude of the vibration increased in the direction from the center portion to the peripheral portion of the tension masks (that is, in the X axis direction). Thus, it becomes evident that the vibration of the tension masks is reduced.

However, in the tension mask according to the above described first comparative example in which the vertical pitch of a real bridge and the value M are uniform over the entire surface of the mask, the decay times of a vibration at the predetermined locations had no large or appreciable differences from each other, and longer decay times than those in the first through fourth experimental examples, were required at the predetermined locations. Also, in the first comparative example, the amplitude of a vibration was slightly reduced.

In the tension mask frame assembly, such as tension mask frame assembly 100, for a color cathode ray tube according to the present invention having such configurations as described above, for example, the vertical pitch of a real bridge becomes narrower, such as in the above described stepwise relation, in the direction from the center portion to the peripheral portion of the tension mask, such that a supporting force against an external impact is increased, to promote preventing deformation of the tension mask. Also, the interval maintenance force of a real bridge between strips is improved against a tension applied in the directions of the shorter sides of the tension mask, so that contraction due to the tension applied to the tension mask can be reduced.

While there have been illustrated and described what are considered to be preferred embodiments of the present invention, it will be understood by those skilled in the art that various changes and modifications may be made, and equivalents may be substituted for elements thereof, without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention include all embodiments falling within the scope of the appended claims.

What is claimed is:

1. A tension mask frame assembly for a color cathode ray tube, comprising:

a tension mask formed on a plate, the tension mask including a plurality of strips and including a plurality of slots to separate, by a predetermined distance, corresponding adjacent ones of the plurality of strips;

a plurality of real bridges for respectively partitioning corresponding slots of the plurality of slots at a predetermined pitch interval by connecting adjacent ones of the plurality of strips;

a frame for supporting the tension mask, wherein a vertical pitch of the plurality of real bridges in a center portion of the tension mask is greater than a vertical pitch of the plurality of real bridges in a peripheral portion of the tension mask; and a plurality of dummy bridges, each dummy bridge being formed adjacent to a corresponding slot partitioned by a corresponding one of the plurality of real bridges;

wherein a value M is obtained by dividing a vertical pitch of corresponding ones of the plurality of real bridges by a vertical pitch of corresponding ones of the plurality of dummy bridges, and wherein the value M decreases in a stepwise relation in a direction from the center portion of the tension mask to the peripheral portion of the tension mask.

2. The tension mask frame assembly for a color cathode ray tube according to claim 1, each dummy bridge extending from a strip of the plurality of strips on at least one side of a corresponding slot of the plurality of slots in a direction toward a strip of the plurality of strips on an opposite side of the corresponding slot.

3. The tension mask frame assembly for a color cathode ray tube according to claim 2, corresponding dummy bridges of the plurality of dummy bridges adjacent to a corresponding slot of the plurality of slots being in a staggered relation with respect to corresponding dummy bridges of the plurality of dummy bridges adjacent to an opposing slot of the plurality of slots.

4. The tension mask frame assembly for a color cathode ray tube according to claim 2, a portion of the tension mask on one side of a center of the tension mask being symmetrical to a corresponding portion of the tension mask located on an opposing side of the center of the tension mask.

5. The tension mask frame assembly for a cathode ray tube according to claim 2, opposing side portions of the tension mask located with respect to a center of the tension mask being symmetrical.

6. The tension mask frame assembly for a color cathode ray tube according to claim 2, each dummy bridge including a pair of protrusions, each pair of protrusions respectively extending from adjacent strips of the plurality of strips, whereby a corresponding pair of protrusions forming a dummy bridge are disposed in facing relation to each other.

7. A tension mask frame assembly for a color cathode ray tube, comprising:

a tension mask formed on a plate, the tension mask including a plurality of strips and including a plurality of slots to separate, by a predetermined distance, corresponding adjacent ones of the plurality of strips;

a plurality of real bridges for respectively partitioning corresponding slots of the plurality of slots at a predetermined pitch interval by connecting adjacent ones of the plurality of strips;

a frame for supporting the tension mask, whereby a vertical pitch of the plurality of real bridges decreases in a stepwise relation in a direction from a center portion of the tension mask to a peripheral portion of the tension mask; and a plurality of dummy bridges, each dummy bridge being formed adjacent to a corresponding slot partitioned by a corresponding one of the plurality of real bridges;

wherein a value M is obtained by dividing a vertical pitch of corresponding ones of the plurality of real bridges by a vertical pitch of corresponding ones of the plurality of dummy bridges, and wherein the value M decreases in a stepwise relation in a direction from the center portion of the tension mask to the peripheral portion of the tension mask.

8. The tension mask frame assembly for a color cathode ray tube according to claim 7, each dummy bridge extending from a strip of the plurality of strips on at least one side of a corresponding slot of the plurality of slots in a direction toward a strip of the plurality of strips on an opposite side of the corresponding slot.

9. The tension mask frame assembly for a color cathode ray tube according to claim 8, corresponding dummy bridges of the plurality of dummy bridges adjacent to a corresponding slot of the plurality of slots being in a staggered relation with respect to corresponding dummy bridges of the plurality of dummy bridges adjacent to an opposing slot of the plurality of slots.

10. The tension mask frame assembly for a color cathode ray tube according to claim 8, a portion of the tension mask located on one side with respect to a center of the tension mask being symmetrical to a corresponding portion of the tension mask located on an opposing side with respect to the center of the tension mask.

11. The tension mask frame assembly for a color cathode ray tube according to claim 8, opposing side portions of the tension mask located with respect to a center of the tension mask being symmetrical.

12. The tension mask frame assembly for a color cathode ray tube according to claim 8, each dummy bridge including a pair of protrusions, each pair of protrusions respectively extending from adjacent strips of the plurality of strips, whereby a corresponding pair of protrusions forming a dummy bridge are disposed in facing relation to each other.

13. The tension mask frame assembly for a color cathode ray tube according to claim 7, the value M being in the range of $3 \leqq M \leqq 29$.

14. The tension mask frame assembly for a color cathode ray tube according to claim 7, the value M being an integer.

15. The tension mask frame assembly for a color cathode ray tube according to claim 7, the tension mask including a plurality of regions, with a region of the plurality of regions having the value and with an adjacent region adjacent to the region of the plurality of regions having a value M-n, n being a value greater than zero and less than M.

16. The tension mask frame assembly for a color cathode ray tube according to claim 15, the value M being in the range of $3 \leqq M \leqq 29$.

17. The tension mask frame assembly for a color cathode ray tube according to claim 7, a portion of the tension mask located on one side with respect to a center of the tension mask being symmetrical to a corresponding portion of the tension mask located on an opposing side with respect to the center of the tension mask.

18. The tension mask frame assembly for a color cathode ray tube according to claim 7, the stepwise relation being symmetrical for corresponding portions of the tension mask respectively located on opposing side portions with respect to a center of the tension mask.

19. The tension mask frame assembly for a color cathode ray tube according to claim 7, corresponding opposing side portions of the tension mask located with respect to a center of the tension mask being symmetrical.

20. A tension mask frame assembly for a color cathode ray tube, comprising:

a tension mask including a plurality of strips for forming a plurality of slots isolated from each other on a plate at intervals of a predetermined distance;

a plurality of real bridges for respectively partitioning corresponding slots of the plurality of slots at a predetermined pitch interval by connecting adjacent ones of the plurality of strips;

a plurality of dummy bridges, each dummy bridge extending from a strip of the plurality of strips on at least one side of a corresponding slot of the plurality of slots in a direction toward a strip of the plurality of strips on an opposite side of the corresponding slot and being formed adjacent to the corresponding slot that is defined by a corresponding one of the plurality of real bridges and corresponding adjacent ones of the plurality of strips; and a frame for supporting edges of the tension mask, the tension mask being partitioned into a plurality of regions in a direction from a center portion of the tension mask to a peripheral portion of the tension mask, whereby a vertical pitch of corresponding ones of the plurality of real bridges of the tension mask decreases in a stepwise relation in a direction from the center portion of the tension mask to the peripheral portion of the tension mask, with each decrease in the stepwise relation corresponding to a corresponding region of the plurality of regions;

wherein a value M is obtained by dividing a vertical pitch of corresponding ones of the plurality of real bridges by a vertical pitch of corresponding ones of the plurality of dummy bridges, and wherein the value M decreases in a stepwise relation in a direction from the center portion of the tension mask to the peripheral portion of the tension mask.

21. The tension mask frame assembly for a color cathode ray tube according to claim 20, each of the plurality of dummy bridges including a pair of protrusions, each said pair of protrusions respectively extending from adjacent strips of the plurality of strips, whereby a corresponding pair of protrusions forming a dummy bridge are disposed in facing relation to each other.

22. The tension mask frame assembly for a color cathode ray tube of claim 20, the value M being in a range of $3 \leqq M \leqq 29$.

23. The tension mask frame assembly for a color cathode ray tube of claim 20, the value M being an integer.

24. The tension mask frame assembly for a color cathode ray tube of claim 20, a region of the plurality of regions of the tension mask having the value M and an adjacent region adjacent to the region of the plurality of regions having a value M-n, n being a value greater than zero and less than M.

25. The tension mask frame assembly for a color cathode ray tube of claim 24, the value M being in a range of $3 \leqq M \leqq 29$.

26. The tension mask frame assembly for a color cathode ray tube according to claim 20, a portion of the tension mask located on one side with respect to a center of the tension mask being symmetrical to a corresponding portion of the tension mask located on an opposing side with respect to the center of the tension mask.

27. The tension mask frame assembly for a color cathode ray tube according to claim 20, the stepwise relation being symmetrical for corresponding portions of the tension mask respectively located on opposing side portions of the tension mask with respect to a center of the tension mask.

28. The tension mask frame assembly for a color cathode ray tube according to claim 20, corresponding regions of the plurality of regions respectively located on opposing side portions of the tension mask with respect to a center of the tension mask being symmetrical.

29. The tension mask frame assembly for a color cathode ray tube according to claim 21, of the stepwise relation being symmetrical for corresponding regions of the plurality of regions respectively located on opposing side portions of the tension mask with respect to a center of the tension mask.

30. A tension mask assembly for a color cathode ray tube, comprising:

a tension mask formed on a plate, the tension mask including a plurality of strips and including a plurality of slots to separate, by a predetermined distance, corresponding adjacent ones of the plurality of strips;

a plurality of real bridges for respectively partitioning corresponding slots of the plurality of slots at a predetermined pitch interval by connecting adjacent ones of the plurality of strips, whereby a vertical pitch of the plurality of real bridges in a center portion of the tension mask is greater than a vertical pitch of the plurality of real bridges to in a peripheral portion of the tension mask; and a plurality of dummy bridges, each dummy bridge being formed adjacent to a corresponding slot partitioned by a corresponding one of the plurality of real bridges;

wherein a value M is obtained by dividing a vertical pitch of corresponding ones of the plurality of real bridges by a vertical pitch of corresponding ones of the plurality of dummy bridges, and wherein the value M decreases in a stepwise relation in a direction from the center portion of the tension mask to the peripheral portion of the tension mask.

31. The tension mask assembly for a color cathode ray tube according to claim 30, each dummy bridge extending from a strip of the plurality of strips on at least one side of a corresponding slot of the plurality of slots in a direction toward a strip of the plurality of strips on an opposite side of the corresponding slot.

32. The tension mask assembly for a color cathode ray tube according to claim 31, corresponding dummy bridges of the plurality of dummy bridges adjacent to a corresponding slot of the plurality of slots being in a staggered relation with respect to corresponding dummy bridges of the plurality of dummy bridges adjacent to an opposing slot of the plurality of slots.

33. The tension mask assembly for a color cathode ray tube according to claim 31, a portion of the tension mask on one side of a center of the tension mask being symmetrical to a corresponding portion of the tension mask located on an opposing side of the center of the tension mask.

34. The tension mask assemble for a color cathode ray tube according to claim 31, each dummy bridge including a pair of protrusions, each pair of protrusions respectively extending from adjacent strips of the plurality of strips, whereby a corresponding pair of protrusions forming a dummy bridge are disposed in facing relation to each other.

35. A tension mask assembly for a color cathode ray tube, comprising:

a tension mask formed on a plate, the tension mask including a plurality of strips and including a plurality of slots to separate, by a predetermined distance, corresponding adjacent ones of the plurality of strips;

a plurality of real bridges for respectively partitioning corresponding slots of the plurality of slots at a predetermined pitch interval by connecting adjacent ones of the plurality of strips, whereby a vertical pitch of the plurality of real bridges decreases in a stepwise relation in a direction from a center portion of the tension mask to a peripheral portion of the tension mask; and a plurality of dummy bridges each dummy bridge being formed adjacent to a corresponding slot partitioned by a corresponding one of the plurality of real bridges;

wherein a value M is obtained by dividing a vertical pitch of corresponding ones of the plurality of real bridges by a vertical pitch of corresponding ones of the plurality of dummy bridges, and wherein the value M decreases in a stepwise relation in a direction from the center portion of the tension mask to the peripheral portion of the tension mask.

36. The tension mask assemble for a color cathode ray tube according to claim 35, each dummy bridge extending from a strip of the plurality of strips on at least one side of a corresponding slot of the plurality of slots in a direction toward a strip of the plurality of strips on an opposite side of the corresponding slot and being formed adjacent to the corresponding slot that is partitioned by a corresponding one of the plurality of real bridges.

37. The tension mask assemble for a color cathode ray tube according to claim 36, a portion of the tension mask located on one side with respect to a center of the tension mask being symmetrical to a corresponding portion of the tension mask located on an opposing side with respect to the center of the tension mask.

38. The tension mask assembly for a color cathode ray tube according to claim 36, each dummy bridge including a pair of protrusions, each pair of protrusions respectively extending from adjacent strips of the plurality of strips, whereby a corresponding pair of protrusions forming a dummy bridge are disposed in facing relation to each other.

39. The tension mask assemble for a color cathode ray tube according to claim 35, the value M being in the range of $3 \leqq M \leqq 29$.

40. The tension mask assembly for a color cathode ray tube according to claim 35, a portion of the tension mask located on one side with respect to a center of the tension mask being symmetrical to a corresponding portion of the tension mask located on an opposing side with respect to the center of the tension mask.

41. The tension mask assembly for a color cathode ray tube according to claim 35, the stepwise relation being symmetrical for corresponding portions of the tension mask respectively located on opposing side portions with respect to a center of the tension mask.

42. A tension mask assembly for a color cathode ray tube, comprising:

a tension mask including a plurality of strips for forming a plurality of slots isolated from each other on a plate at intervals of a predetermined distance;

a plurality of real bridges for respectively partitioning corresponding slots of the plurality of slots at a predetermined pitch interval by connecting adjacent ones of the plurality of strips; and a plurality of dummy bridges, each dummy bridge extending from a strip of the plurality of strips on at least one side of a corresponding slot of the plurality of slots in a direction toward a strip of the plurality of strips on an opposite side of the corresponding slot, and being formed adjacent to the corresponding slot that is defined by a corresponding one of the plurality of real bridges and corresponding adjacent ones of the plurality of strips, the tension mask being partitioned into a plurality of regions in a direction from a center portion of the tension mask to a peripheral portion of the tension mask, whereby a vertical pitch of corresponding ones of the plurality of real bridges of the tension mask decreases in a stepwise relation in a direction from the center portion of the tension mask to the peripheral portion of the tension mask, with each decrease in the stepwise relation corresponding to a corresponding region of the plurality of regions;

wherein a value M is obtained by dividing a vertical pitch of corresponding ones of the plurality of real bridges by a vertical pitch of corresponding ones of the plurality of dummy bridges and wherein the value M decreases in a stepwise relation in a direction from the center portion of the tension mask to the peripheral portion of the tension mask.

43. The tension mask assembly for a color cathode ray tube of claim 42, the value M being in a range of $3 \leqq M \leqq 29$.

44. The tension mask assembly for a color cathode ray tube of claim 42, a region of the plurality of regions of the tension mask having the value M and an adjacent region adjacent to the region of the plurality of regions having a value M-n, n being a value greater than zero and less than M.

45. The tension mask assembly for a color cathode ray tube of claim 44, the value M being in a range of $3 \leqq M \leqq 29$.

46. The tension mask assembly for a color cathode ray tube according to claim 42, a portion of the tension mask located on one side with respect to a center of the tension mask being symmetrical to a corresponding portion of the tension mask located on an opposing side with respect to the center of the tension mask.

47. The tension mask assembly for a color cathode ray tube according to claim 42, the stepwise relation being symmetrical for corresponding portions of the tension mask respectively located on opposing side portions of the tension mask with respect to a center of the tension mask.

48. The tension mask assembly for a color cathode ray tube according to claim 42, corresponding regions of the plurality of regions respectively located on opposing side portions of the tension mask with respect to a center of the tension mask being symmetrical.

* * * * *